US009126799B2

(12) United States Patent
Barea

(10) Patent No.: US 9,126,799 B2
(45) Date of Patent: Sep. 8, 2015

(54) YARN STORAGE FEED DEVICE

(71) Applicant: Tiziano Barea, Busto Arsizio (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 135 days.

(21) Appl. No.: 13/668,254

(22) Filed: Nov. 3, 2012

(65) Prior Publication Data

US 2013/0119177 A1 May 16, 2013

(30) Foreign Application Priority Data

Nov. 11, 2011 (IT) ..... MI2011A2046

(51) Int. Cl.
*D03D 47/36* (2006.01)
*D04B 15/48* (2006.01)
*B65H 51/22* (2006.01)

(52) U.S. Cl.
CPC ..... *B65H 51/22* (2013.01); *D03D 47/367* (2013.01); *D04B 15/486* (2013.01); *B65H 2701/31* (2013.01)

(58) Field of Classification Search
CPC ..... D03D 47/367; D04B 15/486; B65H 51/22
USPC ..... 242/364.7–364.8
See application file for complete search history.

(56) References Cited

U.S. PATENT DOCUMENTS 4,852,617 A * 8/1989 Hamer et al. ..... 139/452
5,291,024 A 3/1994 Barea

FOREIGN PATENT DOCUMENTS

| | | | |
|---|---|---|---|
| BE | 1009172 | A3 | 12/1996 |
| CN | 1074255 | A | 7/1993 |
| CN | 1419615 | A | 5/2003 |
| DE | 3904807 | A1 | 7/1989 |
| WO | 01/71077 | A1 | 9/2001 |

OTHER PUBLICATIONS

Search Report, May 6, 2015, from corresponding translation CN Pat. App. No. 201210444527.2 with English language translation.
Office Action, May 14, 2015, from corresponding CN Pat. App. No. 201210444527.2 with English language translation.

* cited by examiner

*Primary Examiner* — William E Dondero
(74) *Attorney, Agent, or Firm* — Novak Druce Connolly Bove + Quigg LLP

(57) ABSTRACT

A storage feed device for a yarn which unwinds from a corresponding bobbin and is fed to a textile machine. The device includes a rotary or fixed drum and an optical sensor member arranged to sense the movement of the yarn towards the textile machine. The optical sensor includes a plurality of emitters and receivers between which a light beam is generated and is interrupted by the yarn during its movement. The optical sensor includes a first fixed part and a second fixed part which includes the emitter and receiver elements, the first part being coaxial with the rotary member, the second being annular and surrounding the first part, the yarn moving between the parts.

20 Claims, 6 Drawing Sheets

YARN STORAGE FEED DEVICE

CROSS-REFERENCE TO RELATED APPLICATIONS

This application claims priority under 35 USC 119 from Italian Patent Application No. N. MI2011A002046, filed on Nov. 11, 2011, incorporated herein by reference.

FIELD OF THE INVENTION

The present invention relates to a yarn storage feed device in accordance with the introduction to the main claim. In particular, the invention relates to a yarn storage feed device able to measure with absolute precision the fed yarn quantity and the yarn quantity present on the drum.

BACKGROUND OF THE INVENTION

Various types of yarn feed devices or feeders are known in which the yarn originating from a spool or bobbin is deposited onto a fixed drum loaded by an external member driven by its own motor, or onto a rotating drum from which it is withdrawn by the textile machine. In these feeders a system has necessarily to be provided for measuring or counting the number of turns present on the drum such that the yarn stock present on this latter remains virtually constant, and to prevent it from being totally consumed by the machine, with obvious problems for the operation thereof.

Various methods for measuring the yarn quantity (or number of turns) present on the drum are known. A first of these utilizes the reflection of light generated by an emitter and received by a corresponding receiver which are associated with the feeder. One or two reading zones (comprising emitters and receivers) are used to verify that at least one turn is present within them. Usually, one is positioned at the drum entry (yarn inlet zone) and one at the drum exit (yarn outlet zone) to control the so-called minimum stock and maximum stock respectively.

Feeders provided with this type of control are however able to ensure only that the number of turns is within a given range, but are not able to know their exact number (with the consequent impossibility of knowing how much yarn is stored on the drum, of which the lateral surface area is known).

The aforedescribed reflection method also has the limit of its well known dependence on the colour of the yarn to be monitored, and which can negatively affect the effectiveness of sensing the yarn by the optical elements utilized by the method under examination.

Feeders are also present in which the turns unloaded from the drum (and hence the fed yarn quantity) can be counted, again by reflection, however these known devices also present the limit that the reading resolution is strongly influenced by the yarn colour and by any dirt and dust deposits on the optical elements by which the number of turns is measured.

Other feed devices comprise optical elements inserted into a single emitter/receiver member and hence do not comprise separated emitter and receiver portions. This emitter/receiver member is of barrier operation and is able to measure the yarn quantity which has moved in front of it (i.e. the yarn quantity fed and hence the yarn quantity remaining on the drum), however as it does not know the exact position of the yarn within the sensor it is unable to know the yarn position at the feeder outlet, consequently it is unable to offer optimal resolution and precision.

Other feeders comprise mechanical solutions using mechanical lever detectors to which sensors (proximity sensors, Hall sensors) are connected to determine a minimum and a maximum yarn stock on the drum.

Such solutions again do not enable the number of turns present on the drum to be known exactly; moreover, the mechanical action of the levers modifies the yarn tension, with obvious repercussions on the yarn fed to the textile machine.

SUMMARY OF THE INVENTION

An object of the invention is to provide a feed device able to measure with absolute precision the yarn stored on the drum and simultaneously the yarn quantity withdrawn by the textile machine.

Another object of the present invention is to provide a device able to monitor a yarn feed which does not suffer from those limits of reflection-operated optical solutions related for example to the yarn colour and to dirt accumulation.

A further object of the present invention is to provide a device which is not influenced by the presence of dust or the like, by being subjected to cleaning by yarn passage along the device.

Another object of the present invention is to provide a device able to measure with high resolution the yarn quantity absorbed (AYL) by the textile machine.

A further object of the present invention is to provide a device which does not influence the yarn during its passage from the feeder to the textile machine.

Another object of the present invention is to provide a device able to sense the lack of yarn or its breakage and possibly to indicate this to the textile machine.

A further object of the present invention is to provide a device able to count with absolute precision the number of turns deposited on the drum during its loading, starting from the unloaded drum and during all the subsequent operative stages of withdrawal by the textile machine.

These and other objects which will be apparent to the expert of the art are attained by a feed device in accordance with the accompanying claims.

BRIEF DESCRIPTION OF THE DRAWINGS

The present invention will be more apparent from the accompanying drawings, which are provided by way of non-limiting example and in which.

DESCRIPTION OF THE PREFERRED EMBODIMENTS

Figure 4:
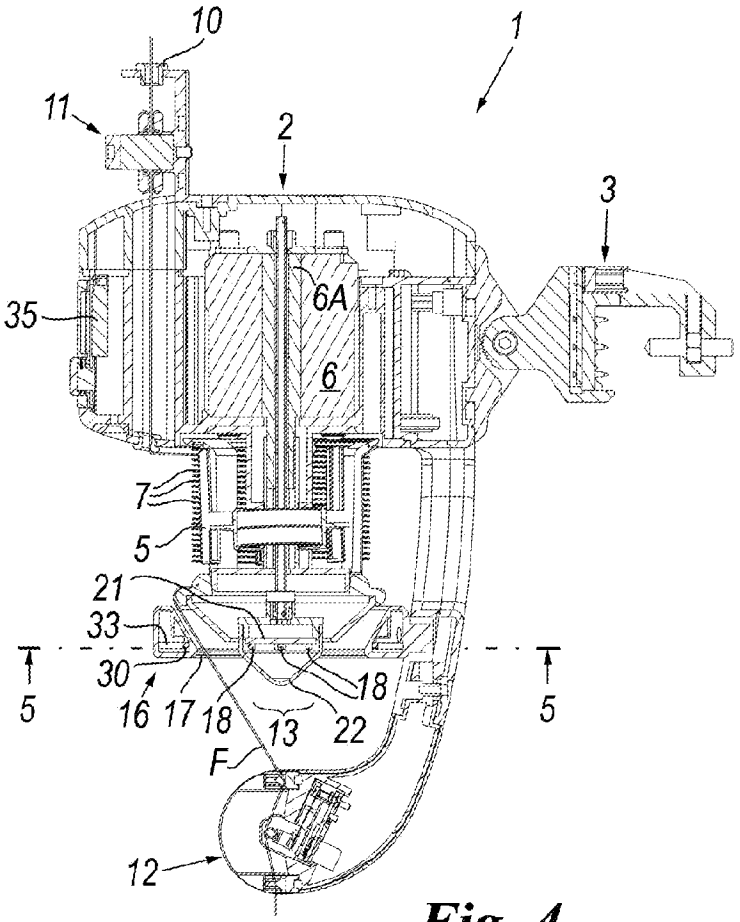
FIG. 4 is a section on the line 4-4 of FIG. 1.
Figure 1:
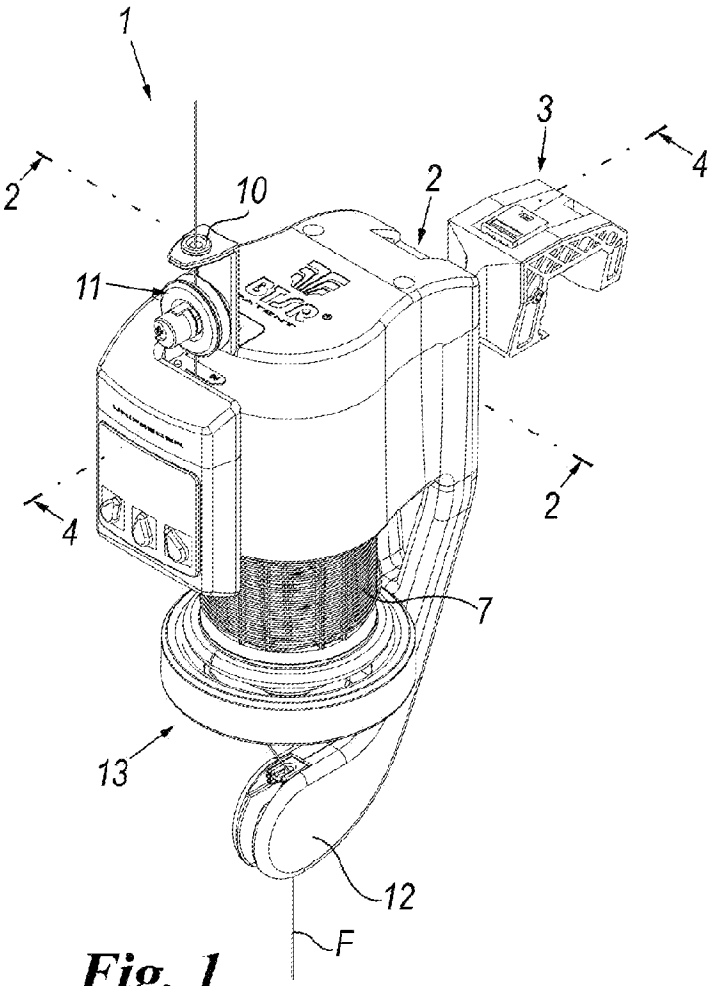
FIG. 1 is a perspective view of a device formed in accordance with the invention.
Figure 2:
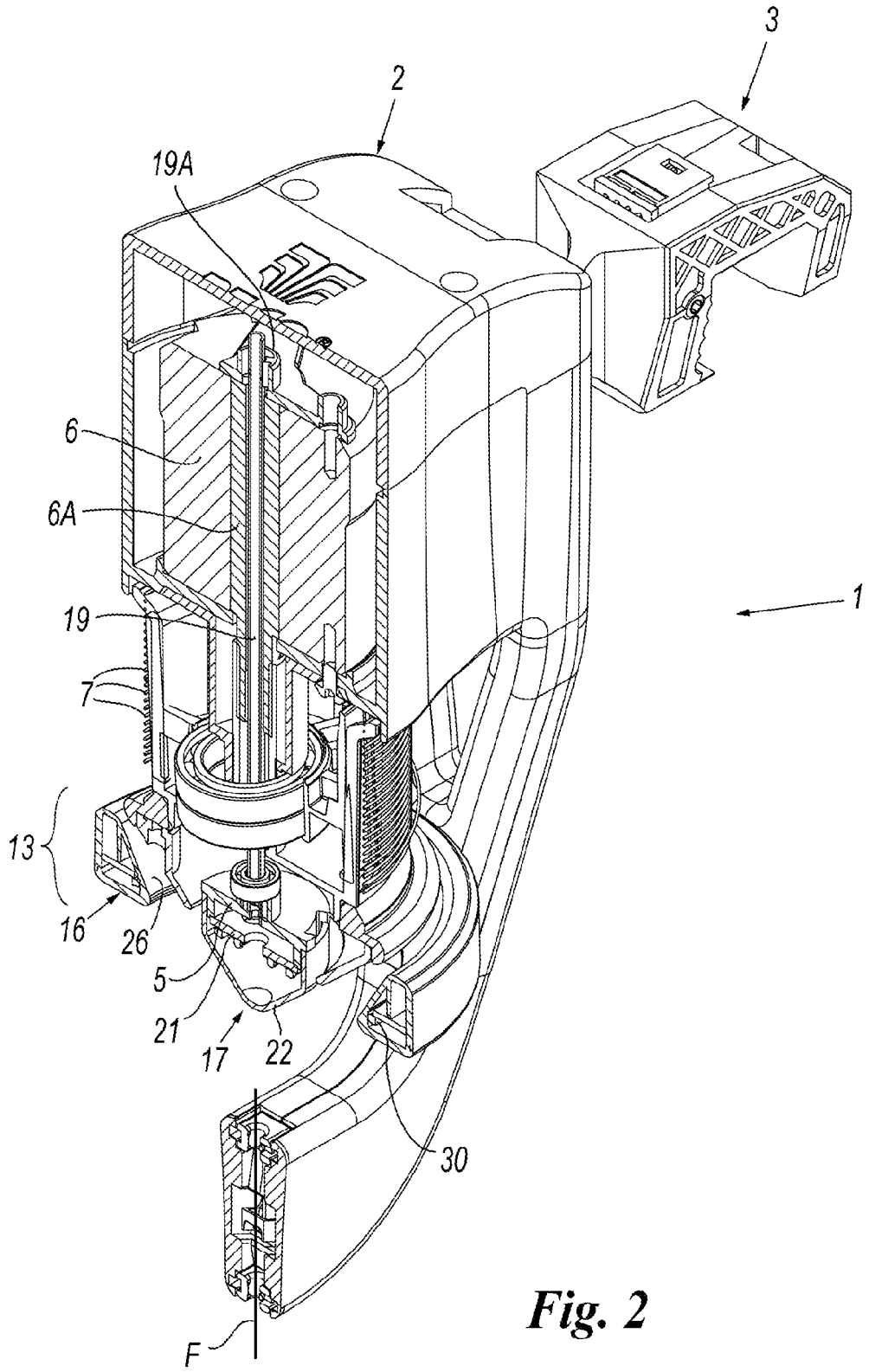
FIG. 2 is a section therethrough on the line 2-2 of FIG. 1.
Figure 3:
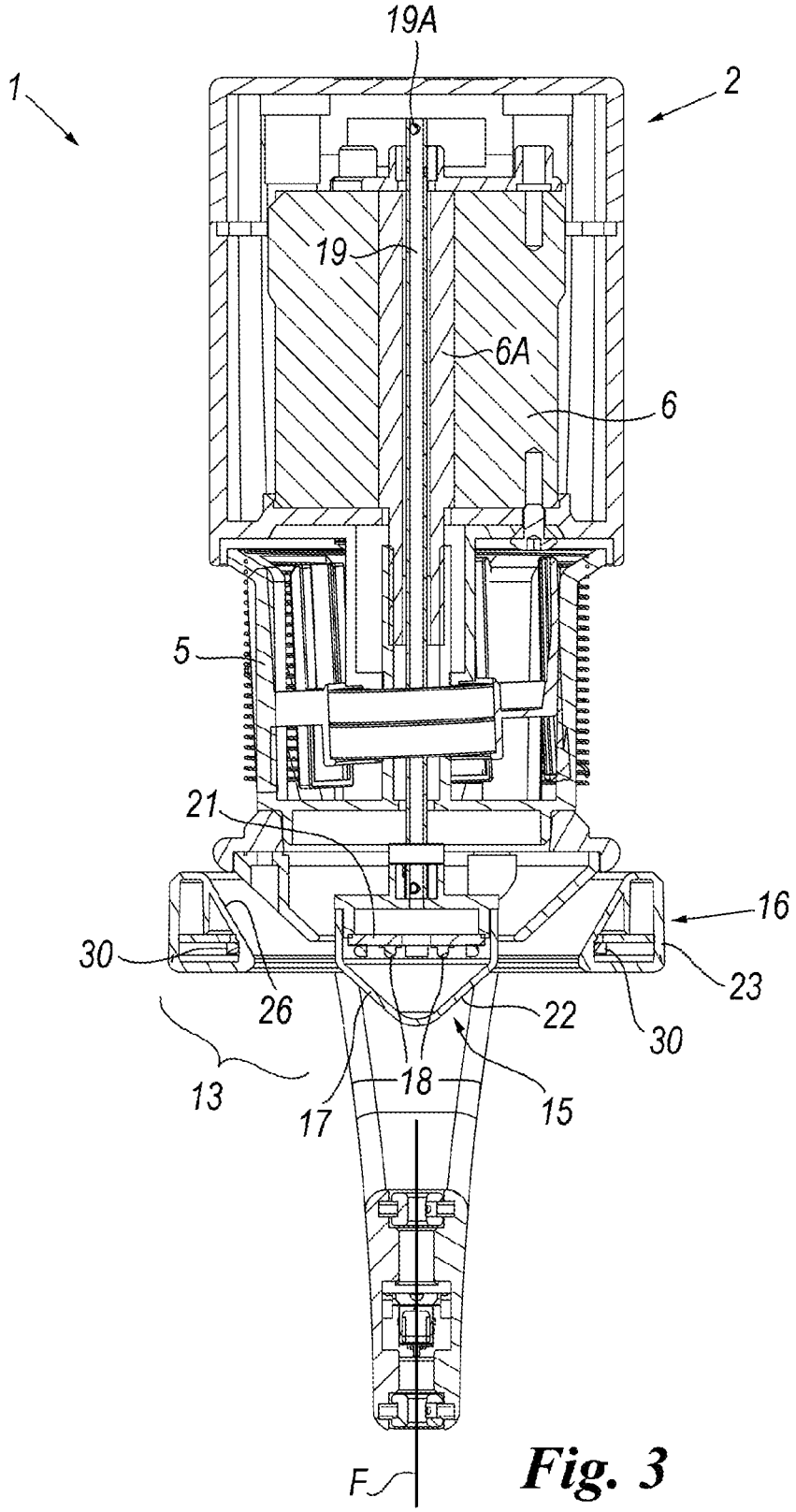
FIG. 3 is a front view of the section of FIG. 2.

With reference to said figures, a feed device according to the invention is indicated overall by 1 and comprises a casing 2 provided with a fixing bracket 3 to enable the device to be fixed to a support (not shown) associated with, or close to, a textile machine (not shown).

The casing 2 carries a rotary member or drum 5 driven (in any known manner) by its own electric motor or actuator 6 (with hollow shaft 6A) contained within the casing 2. A yarn F is wound about this drum before leaving the feed device and reaching the textile machine; the yarn F forms a plurality of turns 7 on the drum 5 to hence define a yarn stock for the machine such as to always enable its optimal operation even in the presence of discontinuous yarn withdrawals by said machine, for producing a particular article (for example a mesh).

The yarn F entering the device 1 cooperates with one or more thread guides 10 (only one being shown in the figures), for example of ceramic, which define its trajectory in entering said device such as to prevent the yarn F from coming into contact with the casing 2 (hence undergoing damage or creating overtensions deleterious for the proper operation of the device 1 and for correct yarn feed to the textile machine).

The feed device 1 preferably presents an entry yarn brake 11 and a tension sensor 12, of known type and therefore not described. The thread guide 10 and the yarn brake 11 project from the casing 2.

The feeder 1 presents an optical sensor 13 to measure the quantity of yarn F on which the feeder operates. The sensor 13 comprises a first part 15 and a second part 16 surrounding the first; the first part is defined by a part 17 (totally or partly, for example in a lateral surface 22 thereof, of any known light transparent material), disposed coaxially to the rotary drum 5 and containing a plurality of light emitting members or transmitting photodiodes 18. The part 17 is supported by the casing 2 via a tube 19 positioned within the hollow shaft 6A and fixed at one end 18A to this casing. The cable for handling the necessary signals sent and received by the sensor 13 passes within the tube.

The photodiodes 18 are associated with an electronic circuit or electronic card 21 contained in the part 17 which is present in a stationary position at one end of the drum 5 from which the yarn F leaves to reach the textile machine.

The second part 16 of the sensor 13, also stationary, is defined by a hollow annular part 23 present at the casing 2. The part 23 comprises at least one transparent portion 26 facing the first part 15 and containing a plurality of receiver photodiodes 30, of a number equal to the number of transmitter photodiodes 18 and disposed within the part 16 such as to receive the light signals emitted by the corresponding transmitter 18 (for example such as to face these emitters).

The receivers 30 are also associated with an electronic circuit or card 33 inserted into the part 16 and connected electrically to a control unit 35 of the device 1 to control the feeder operation.

The unit 35, in particular, cooperates with a memory unit (not shown) in which the "physical" data of the rotary drum 5, i.e. its diameter, are contained; the unit 35 also commands and controls the operation of the motor 6, of which the rotational velocity is hence always known by known control elements (for example Hall sensors).

During use of the device 1, the yarn F unwinds from a corresponding bobbin or spool (not shown), and passes through the thread guide 10 and the yarn brake 11.

At this point the yarn F is wound onto the drum for a predetermined number of turns 7 (possibly programmable); the purpose of this drum is to feed the yarn F by withdrawing it from the spool in order to feed it to the textile machine, while at the same time separating said yarn present on the drum such that the individual turns 7 are unable to superimpose on and/or touch each other.

Before abandoning the device, the yarn F passes through the sensor 12 which, by known methods, measures its tension, then it possibly passes through a further braking member (not shown) which further determines and controls its braking.

Figure 5:
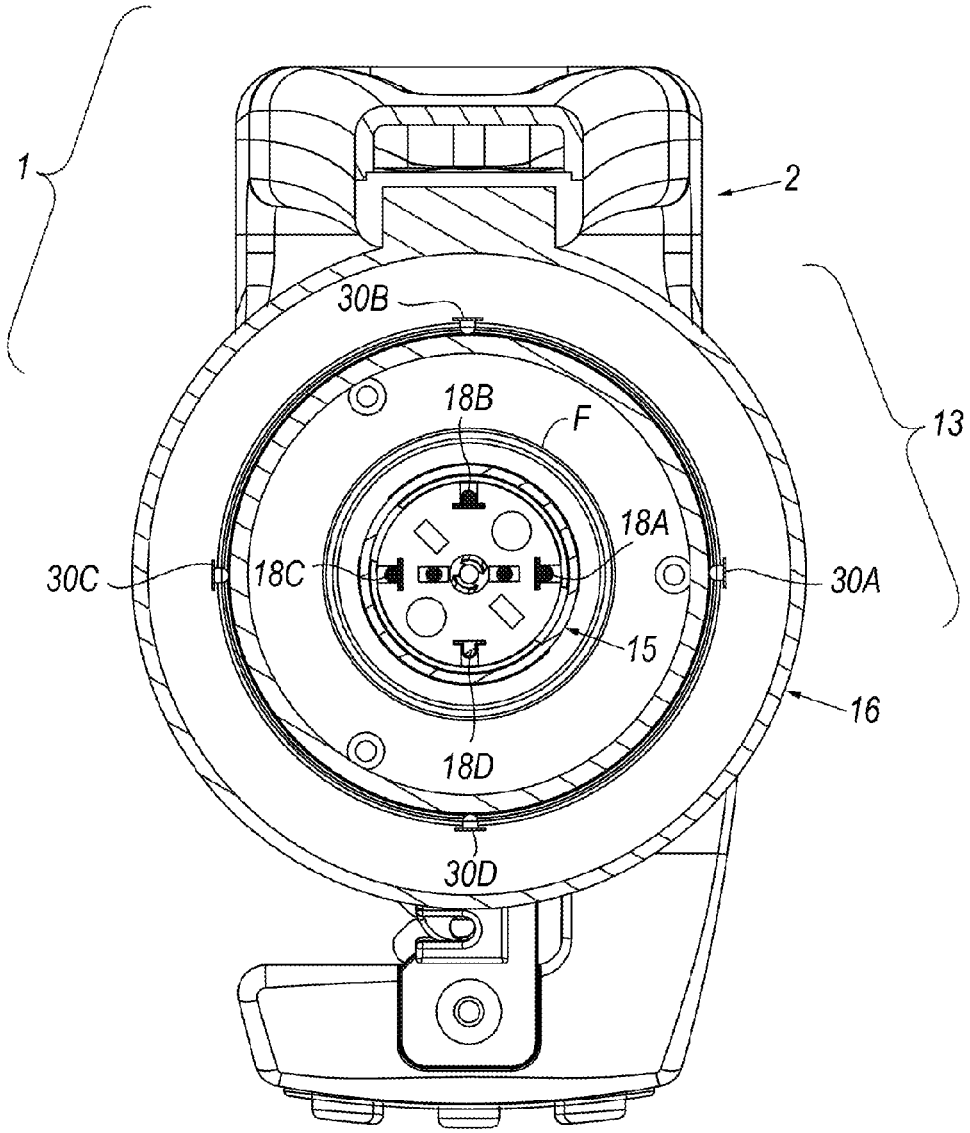
FIG. 5 is a section on the line 5-5 of FIG. 4.

In proximity to its point of exit from the drum 5, the yarn F passes through the optical sensor 13 shown in greater detail in FIG. 5. By way of example, this shows four transmitters (indicated by 18A, B, C, D) and four receiver photodiodes (30A, B, C, D), the yarn F withdrawn by the textile machine (and shown as a circumference as it detaches from the drum 5), and the parts of the sensor 13.

The photodiodes 18 and 30 determine four light rays or beams which the yarn F interrupts by passing in front of them, i.e. "light barriers" which are indicated in FIG. 5 by A, B, C, D.

The suitably conditioned signal (i.e. amplified and filtered by known electrical/electronic members, not shown, associated with the card 33) of each receiver element 30A, B, C, D is fed to the control unit 35 of the entire device. This control unit, by analyzing the state of each barrier and knowing the drum rotation direction, is able to verify the yarn position and to know if the yarn has been loaded onto or unloaded from the drum, during the operating stages of the textile machine. In this respect, it will be assumed that the drum 5 on which the yarn F is deposited rotates clockwise; when the control unit 35 senses a barrier activation sequence (i.e. the sequence of interruption of light beams between the pairs of transmitter photodiodes and receivers 18A, B, C, D and 30A, B, C, D) of the type A→B→C→D→A→B→C . . . , it determines that this yarn has been loaded on the drum and defines this sequence as a LOAD sequence.

When the electronic control unit 35 senses a barrier activation sequence of the type D→C→B→A→D→C . . . , it determines that this yarn F has been unloaded from the drum 5 and defines this sequence as an UNLOAD sequence.

It is therefore evident that by utilizing the data originating from the optical sensor 13 and by knowing and regulating the velocity and position of the feed drum, the control unit 35 is able to perform the following operations:

1) during the loading of the device 1 (sequence in which the yarn is wound onto the drum starting from a drum 5 unloaded condition), the unit 35 counts with absolute precision the number of turns 7 loaded, from which the yarn quantity in mm available as stock can be obtained with precision. In this respect, the control unit 35 causes the drum 5 to rotate at a fixed or variable velocity (by commanding and controlling the motor 6 in any known manner) and monitors the optical sensor 13, to halt the movement of the drum 5 as soon as it has counted a number of change-overs (A→B, B→C, . . . ) equal to four times the number of revolutions to be carried out.

2) The unit 35 senses that the textile machine has begun to withdraw yarn from the feeder when, by analyzing the barrier activation sequence, it determines that an UNLOAD sequence is underway. In response to an UNLOAD sequence, this unit begins to rotate the drum 5 such that the number of turns 7 present as stock remains constant and equal for example to a possibly programmable predetermined value.

In particular, the control unit 35 increases o decreases the velocity of the motor 6 which controls the drum in response to an UNLOAD sequence or LOAD sequence respectively, in accordance with known control algorithms (for example P, PI, PD, PID), by closing a control loop for the yarn quantity present on the drum.

Then by processing the data relative to drum velocity and position and the state of the optical sensor 13, the control unit always known with absolute precision the yarn quantity present on the drum (stock) and the yarn quantity withdrawn by the machine in real time.

The yarn quantity present on the drum (known hereafter as REAL TIME YARN STOCK) is in fact the algebraic sum of the UNLOAD and LOAD sequence with respect to the initial yarn quantity known as the YARN STOCK.

For example, assuming that the drum 5 has a linear development equal to 200 mm and assuming that during the loading stage the device has loaded ten turns and hence 2000 mm of yarn (turn number×development→10×200=2000), then at each UNLOAD sequence a value of 50 mm (development/number of sensors→200/4=50) is subtracted from the yarn quantity present on the REAL TIME YARN STOCK, whereas at each LOAD sequence a value of 50 mm is added.

A brief numerical example follows:

| SENSOR SEQUENCE | CODE | YARN STOCK | REAL TIME STOCK |
|---|---|---|---|
| | | 2000 | 2000 |
| A→B | LOAD | 2000 | 2050 |
| B→C | LOAD | 2000 | 2100 |
| C→B | UNLOAD | 2000 | 2050 |

The yarn quantity withdrawn by the textile machine is given by the difference between the initial yarn quantity YARN STOCK and the actual yarn quantity REAL TIME YARN STOCK added to the number of drum revolutions.

Let us imagine that the control unit 35 does not cause the drum 5 to rotate in order to reload the yarn withdrawn by the machine; in this case the withdrawn yarn quantity (ABSORBED YARN QUANTITY AYL) must be incremented by 50 mm for each UNLOAD pulse.

A numerical example follows:

| SENSOR SEQUENCE | CODE | REAL TIME YARN STOCK | FED YARN QUANTITY |
|---|---|---|---|
| | | 2000 | 0 |
| B→A | UNLOAD | 1950 | 50 |
| A→D | UNLOAD | 1900 | 100 |
| D→B | UNLOAD | 1850 | 150 |

At the moment in which the control unit 35 begins to cause the drum 5 to reload from the bobbin or spool those turns withdrawn by the machine, the yarn quantity (AYL) is given by the algebraic sum of the YARN STOCK and the REAL TIME YARN STOCK to which a quantity of 200 mm (drum development) must be added for each motor revolution. This is shown in the following table.

| SENSOR SEQUENCE | CODE | REAL TIME YARN STOCK | MOTOR R.P.M. | FED YARN QUANTITY |
|---|---|---|---|---|
| | | 2000 | 0 | 0 |
| B→A | UNLOAD | 1950 | 0 | 50 |
| A→D | UNLOAD | 1900 | 0 | 100 |
| D→A | LOAD | 1950 | 1 | 250 |

From the previously given examples it is apparent that the unit 35 is able to measure with absolute precision the value of the stock of yarn F and the yarn quantity absorbed (AYL) by the textile machine.

It should be noted that the resolution of the two measurements can be improved; for example, the number of optical barriers can be incremented, such as to reduce the minimum increment and decrement step calculated as the drum development divided by the number of barriers.

An encoder can be used to know the exact position of the motor 6 and hence of the drum 5 such that the contribution given by the rotation of the motor 6 in the calculation of the fed yarn quantity is not an exact multiple of the drum development, but a function of its position (hence also taking account of the fractions of a revolution, with greater encoder resolution and greater measurement resolution).

For example by using a 4096 position encoder, precisions can be achieved which are less than one tenth of a millimeter.

One of the possible embodiments of the invention has been described; others are however possible in the light of the preceding description. For example, the number of barriers could be greater or less than four, odd or even, and comprise at least one pair of emitters and at least one pair of receivers; obviously, as the number of barriers increases, the counting precision varies, as already indicated. Moreover, the barriers could operate not "by interruption" but "by reflection"; hence in this latter case, each transmitter and the corresponding receiver lie on the same part 15 or 16 of the sensor 13, with a mirror being mounted on the opposite part (16 or 15), such that the system again operates as a barrier.

According to another variant, the passage of the yarn F is intercepted not as the interruption of a light beam but as the sliding of the yarn. This solution has the great advantage of verifying yarn passage not within a single point (crossing of the barrier light beam), but within an angular sector centred on the receiver element. This enables the passage condition to be intercepted with greater safety as it derives not from an instantaneous condition but from a condition of greater duration in terms of time. This makes the sensor much more robust and able to read any type of yarn with precision, in particular even very thin yarns.

As an alternative to that described, the barriers or the generated light beams could be partially superimposed in pairs, such as to have for each sensitive element two signals CHA and CHB and hence obtain the passage and direction data from the state of the transition CHA→CHB or vice versa (unwind, wind→LOAD, UNLOAD). In this manner the sensor 13 operates as an optical encoder.

Figure 6:
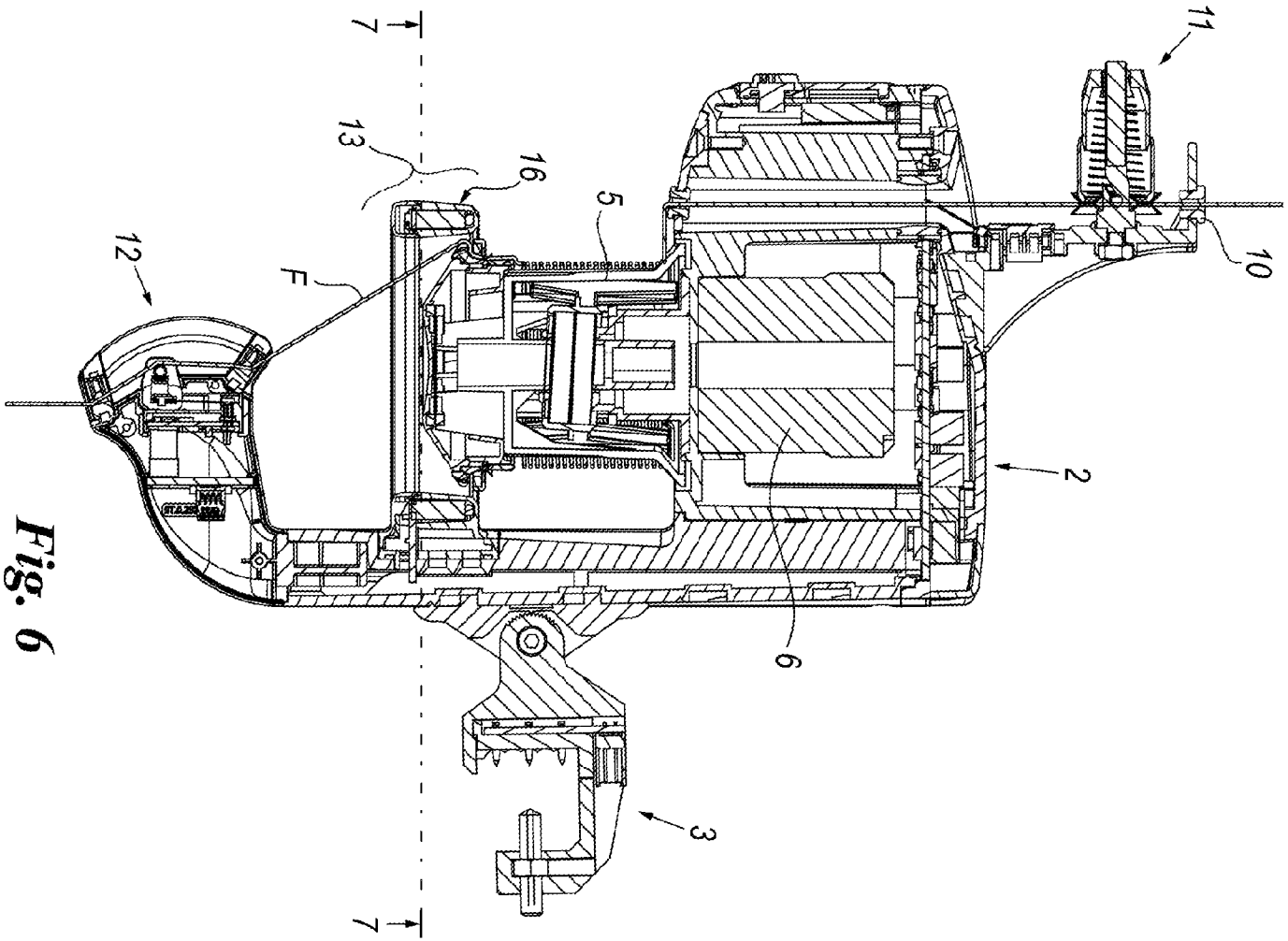
FIG. 6 is a view similar to that of FIG. 4, but of a variant of the invention.
Figure 7:
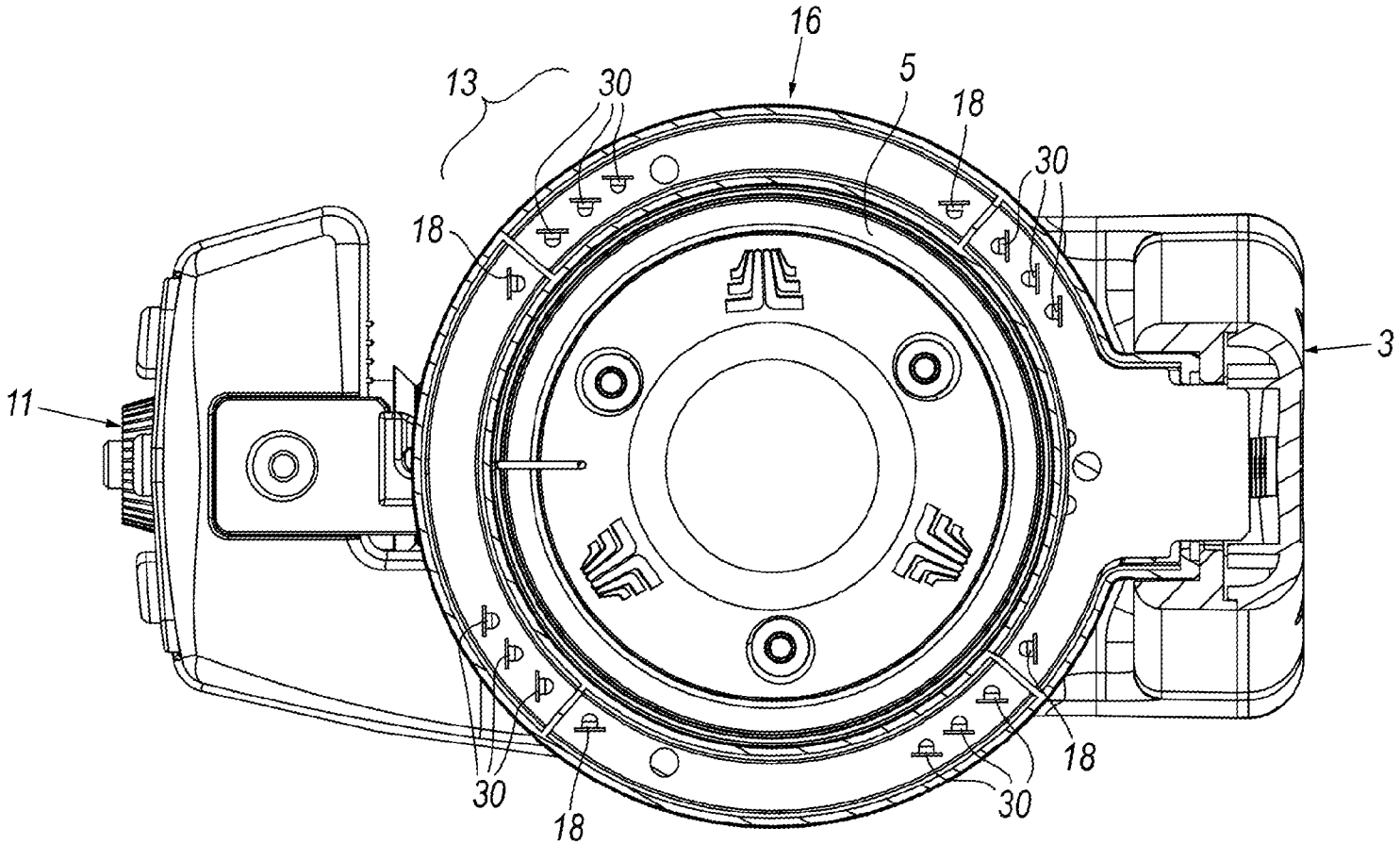
FIG. 7 is a section on the line 7-7 of FIG. 6.

FIGS. 6 and 7, in which parts corresponding to those of the already described figures are indicated by the same reference numerals, show a further variant of the invention. According to this latter, the transmitters and the corresponding receivers are located on the second part 16 of the sensor 13, the first part 15 now having been eliminated.

The second part 16 surrounds the member 5 even though distant therefrom (lower, in FIG. 6). This second part contains the emitters 18 and receivers 30.

The operation of the device shown in FIGS. 6 and 7 is evidently the same as that shown in the already described figures.

Finally, if the feed device is formed as a fixed drum solution and hence the hollow shaft (which passes through it) is used for yarn passage, the hollow shaft transports the electrical signals for controlling the optical sensor.

These embodiments are also to be considered as falling within the scope of the invention as defined by the following claims.

The invention claimed is:

1. A yarn storage feed device for unwinding yarn from a corresponding bobbin to be fed to a textile machine, the yarn storage feed device comprising:

a casing;

a control unit;

a rotary drum driven by a respective electric motor, the motor being controlled and commanded by the control unit, the yarn winding onto the rotary drum in the form of turns; and an optical sensor, connected to the control unit and arranged to sense movement of the yarn, said optical sensor comprising:

a plurality of light emitter elements for generating a plurality of light beams, and a plurality of light receiver elements for receiving the plurality of light beams from the light emitter elements, at least one fixed part with which said light emitter and light receiver elements are associated, said at least one fixed part comprising a fixed annular member coaxial with the rotary drum, the fixed annular member defining a void and being positioned about the rotary drum, wherein at least one of the plurality of light emitter elements, the plurality of light receiver elements, and combinations thereof are associated with the fixed annular member wherein the fixed annular member is located in a position to allow the yarn to move between said rotary drum and said fixed annular member, wherein said plurality of light emitter elements and light receiver elements are located to allow the yarn, moving between said fixed annular member and said rotary drum, to interrupt the plurality of light beams, wherein the control unit is connected to, and is arranged to control, the plurality of light emitter elements and the plurality of light receiver elements on the basis of measurements of a direction of rotation of the electric motor, and a rotational velocity of the electric motor, and signals originating from said plurality of light receiver elements, said control unit for determining whether the yarn is in the stage of being loaded onto the rotary drum or whether the yarn is being unloaded from said rotary drum, hence enabling said control unit to determine how much yarn is present on the rotary drum by defining a number of turns of the yarn on the rotary drum and a quantity of yarn withdrawn by the textile machine.

2. The device as claimed in claim 1, wherein the at least one fixed part of the optical sensor further comprises a fixed central member coaxial with the rotary drum, wherein the fixed annular member surrounds the fixed central member, wherein the plurality of the light emitter elements are positioned in one member selected from the group consisting of said fixed annular member and said fixed central member, wherein the plurality of the light receiver elements are positioned in a member selected from the group consisting of said fixed annular member and said fixed central member other than the member in which the light emitter elements are positioned, said optical sensor for operating by interruption of the light generated by said light emitter elements and received by said light receiver elements.

3. The device as claimed in claim 2, wherein the fixed central member of the optical sensor is positioned beyond an end of the rotary drum from which the yarn unwinds and is supported by the device casing, said central member having a portion containing the plurality of light emitter elements and provided with a first transparent surface, in front of the first transparent surface there being a corresponding second transparent portion of the fixed annular member which contains the plurality of light receiver elements.

4. The device as claimed in claim 1, wherein the at least one fixed part of the optical sensor further comprises a fixed central member coaxial with the rotary drum, the fixed annular member surrounding the fixed central member, the light emitter elements and the light receiver elements both positioned in one member selected from the group consisting of the fixed central member and the fixed annular member of the optical sensor, a reflecting element associated with a member selected from the group consisting of the fixed central member and the fixed annular member other than the member in which the light emitter elements and the light receiver elements are positioned, wherein the reflecting element is positioned in opposition to the plurality of light emitter elements and the plurality of light receiver elements for operating the optical sensor by reflection.

5. The device as claimed in claim 1, wherein the plurality of light emitter elements and the plurality of light receiver elements are both positioned in the fixed annular member of the optical sensor, the yarn sliding in front of the optical sensor by unwinding from the rotary drum.

6. The device as claimed in claim 1, wherein the rotary drum is driven by the electric motor via a hollow drive shaft, the device further comprising a support member for a fixed central member inserted through the hollow drive shaft together with the electrical connections for at least one member selected from the group consisting of each of the plurality of emitter elements, each of the plurality of receiver elements, and combinations thereof.

7. The device as claimed in claim 1, wherein the rotary drum is traversed by a hollow shaft for yarn passage which also transports electrical signals for controlling the optical sensor.

8. The device as claimed in claim 1, further comprising an encoder associated with the electric motor and connected to said control unit to enable the control unit to determine an exact spatial position of the rotary member, so increasing the measurement resolution to a value close to the encoder resolution.

9. The device as claimed in claim 1, wherein each of the plurality of light emitter elements generates selectively a light ray and operates as a simple barrier, or a light beam for monitoring both the presence and the sliding of the yarn within the light beam.

10. The device as claimed in claim 1, wherein the light beams are superimposed in pairs for the optical sensor to operate as an optical encoder.

11. The device as claimed in claim 1, wherein the control unit comprises a microprocessor.

12. The device as claimed in claim 1, wherein the optical sensor further comprises a central member, coaxial with the rotary member, and disposed in the annular void of the member, wherein the plurality of emitter elements are positioned in one member selected from the annular member and the central member, wherein the plurality of receiver elements are positioned in another member selected from the annular member and the central member, and wherein each light receiver element said plurality of light receiver elements is positioned in opposition to a respective light emitter element of the plurality of emitter elements.

13. The device as claimed in claim 1, wherein the optical sensor further comprises a central member, coaxial with the rotary member, and disposed in the annular void of the member, wherein the plurality of emitter elements are positioned in one selected from the annular member and the central member, wherein the plurality of light emitter elements are associated with at least one of the fixed annular member and the central member, and the plurality of the light receiver elements are associated with at least one of the fixed annular member and the central member for light emitted from the light emitting element on one of said fixed annular member and the central member to be received by the corresponding light receiver element on the other of said fixed annular member and the central member.

14. A method for feeding a yarn to a textile machine using a storage feed device, the storage feed device comprising a casing, a control unit, a rotary drum driven by a respective motor, the motor being commanded and controlled by the control unit, the yarn winding onto the rotary drum in the form of turns, said control unit being connected to an optical sensor arranged to sense the movement of the yarn, said yarn intercepting, at the exit of the drum, a plurality of light signals generated and received by light emitter and light receiver elements associated with at least one fixed part of the optical sensor, said at least one fixed part comprising an annular member positioned annularly about the rotary drum to be coaxial with the rotary drum, the method, under control of the control unit, and on the basis of an interception sequence of said light signals, comprising the steps of:

determining an operative stage of the feed device, wherein the operative stage indicates whether the yarn is being fed to the textile machine or whether the yarn is being loaded onto the drum, the control unit measuring and regulating a velocity and position of the rotary drum, and based on the velocity and position of the rotary drum the control unit:

counts the quantity of yarn loaded onto the drum;

calculates the quantity of yarn withdrawn by the textile machine; and measures the quantity of yarn remaining on the drum after its withdrawal of the yarn by the textile machine.

15. The method as claimed in claim 14, wherein the control unit comprises a microprocessor.

16. The method as claimed in claim 14, wherein the at least one fixed part of the optical sensor further comprises a fixed central member coaxial with the rotary drum, wherein the fixed annular member surrounds the fixed central member, wherein the plurality of the light emitter elements are positioned in one member selected from the group consisting of said fixed annular member and said fixed central member, wherein the plurality of the light receiver elements are positioned in a member selected from the group consisting of said fixed annular member and said fixed central member other than the member in which the light emitter elements are positioned, said optical sensor for operating by interruption of the light generated by said light emitter elements and received by said light receiver elements.

17. The method as claimed in claim 14, wherein the at least one fixed part of the optical sensor further comprises a fixed central member coaxial with the rotary drum, the fixed annular member surrounding the fixed central member, the light emitter elements and the light receiver elements both positioned in one member selected from the group consisting of the fixed central member and the fixed annular member of the optical sensor, a reflecting element associated with a member selected from the group consisting of the fixed central member and the fixed annular member other than the member in which the light emitter elements and the light receiver elements are positioned, wherein the reflecting element is positioned in opposition to the plurality of light emitter elements and the plurality of light receiver elements for operating the optical sensor by reflection.

18. The method as claimed in claim 14, wherein the plurality of light emitter elements and the plurality of light receiver elements are both positioned in the fixed annular member of the optical sensor, the yarn sliding in front of the optical sensor by unwinding from the rotary drum.

19. The method as claimed in claim 14, wherein the optical sensor further comprises a central member, coaxial with the rotary member, and disposed in a void of the annular member, wherein the plurality of emitter elements are positioned in one member selected from the annular member and the central member, wherein the plurality of receiver elements are positioned in another member selected from the annular member and the central member, and wherein each light receiver element said plurality of light receiver elements is positioned in opposition to a respective light emitter element of the plurality of emitter elements.

20. The method as claimed in claim 14, wherein the optical sensor further comprises a central member, coaxial with the rotary member, and disposed in a void of the annular member, wherein the plurality of emitter elements are positioned in one selected from the annular member and the central member, wherein the plurality of light emitter elements are associated with at least one of the central member and the fixed central member, and the plurality of the light receiver elements are associated with at least one of the fixed annular member and the central member for light emitted from the light emitting element on one of said fixed annular member and the central member to be received by the corresponding light receiver element on the other of said fixed annular member and the central member.

* * * * *

UNITED STATES PATENT AND TRADEMARK OFFICE

CERTIFICATE OF CORRECTION

PATENT NO. : 9,126,799 B2
APPLICATION NO. : 13/668254
DATED : September 8, 2015
INVENTOR(S) : Tiziano Barea It is certified that error appears in the above-identified patent and that said Letters Patent is hereby corrected as shown below:

In the Claims

Claim 1, Column 7, Line 27 should read: "and electrical signals originating..."

Claim 6, Column 8, Line 29 should read: "together with ~~the~~ electrical connections..."

Signed and Sealed this
Nineteenth Day of January, 2016

Michelle K. Lee

Michelle K. Lee
*Director of the United States Patent and Trademark Office*